United States Patent [19]

Rodseth

[11] Patent Number: 4,472,016

[45] Date of Patent: Sep. 18, 1984

[54] TERMINAL BLOCK CONNECTOR

[75] Inventor: William G. Rodseth, Elgin, Ill.

[73] Assignee: Illinois Tool Works, Inc., Chicago, Ill.

[21] Appl. No.: 419,269

[22] Filed: Sep. 17, 1982

[51] Int. Cl.[3] ..... H01R 13/40

[52] U.S. Cl. ..... 339/217 S; 339/258 R

[58] Field of Search ..... 339/217 S, 252 F, 253 F, 339/258 R, 258 F, 258 P, 259 F, 258 S

[56] References Cited

U.S. PATENT DOCUMENTS

| | | | |
|---|---|---|---|
| 1,827,533 | 10/1931 | Martin | 339/258 F |
| 2,229,989 | 1/1941 | Roby | 339/258 F |
| 2,388,883 | 11/1945 | Taylor | 339/253 F |
| 2,908,885 | 10/1959 | Deakin | 339/217 S |
| 3,040,291 | 6/1962 | Schweitzer et al. | 339/217 S |
| 3,245,031 | 4/1966 | Barney et al. | 339/258 R |

FOREIGN PATENT DOCUMENTS

| | | | |
|---|---|---|---|
| 2518003 | 11/1975 | Fed. Rep. of Germany | 339/258 S |
| 305332 | 2/1929 | United Kingdom | 339/258 F |
| 354127 | 8/1931 | United Kingdom | 339/258 F |

*Primary Examiner*—Joseph H. McGlynn

*Attorney, Agent, or Firm*—Thomas W. Buckman; David I. Roche

[57] ABSTRACT

An electrical connector embodying the present invention includes a planar base member having an aperture and a blade receiving portion comprised of a plurality of resilient legs. The legs have concavo-convex surfaces near their free ends which facilitate insertion of a blade connector. Opposing concavo-convex surfaces are biased toward each other. As a result, the connector has a self-cleaning wiping action, and yet allows a blade connector to be installed with low insertion forces.

8 Claims, 7 Drawing Figures

TERMINAL BLOCK CONNECTOR

BACKGROUND AND SUMMARY OF THE INVENTION

This invention relates to an electrical connector for use in a terminal block. More specifically it relates to connectors adapted to receive both screw type terminals and blade type connectors.

Terminal block assemblies of the prior art generally are comprised of a plurality of separate elements including a nut member and blade gripping parts. The assemblies are generally adapted to receive a terminal screw and a blade connector. In some cases, the blade connector is one of a series of such connectors attached to a terminal block cover making the insertion of the blade a somewhat difficult blind operation. It is therefore desirable to have a terminal block connector which will reduce the number of parts in a terminal block assembly and which will also make the insertion of a blade connector easier.

It is the principal object of the present invention to provide a novel electrical connector having utilized construction which will electrically connect a headed screw terminal and a blade connector.

Another object of the present invention is to provide an electrical connector which has good electrical contact and which has a blade cleaning feature.

It is a further object of the present invention to provide an electrical terminal which facilitates the insertion of a blade connector.

Yet another object of the present invention is to provide an electrical connector made from a single stamping which reduces the number of pieces and which facilitates the assembly of terminal blocks.

An electrical connector embodying the present invention includes a planar base member and a blade receiving portion. The base has an aperture which may be threaded to receive a screw terminal. The blade receiving portion is comprised of a plurality of resilient legs which are adapted to receive and contact a blade connector. Portions of the leg are equipped with concavo-convex portions which provide the blade receiving portions with contact surfaces and a blade receiving opening to facilitate insertion of a blade connector. The particular configuration of the legs which comprise the blade receiving portion can be varied as is shown in the attached drawings.

Other object and advantages of the present invention will become apparent upon a reading of the following description in conjunction with the accompanying drawings.

DETAILED DESCRIPTION OF THE PREFERRED EMBODIMENT

Figure 1:
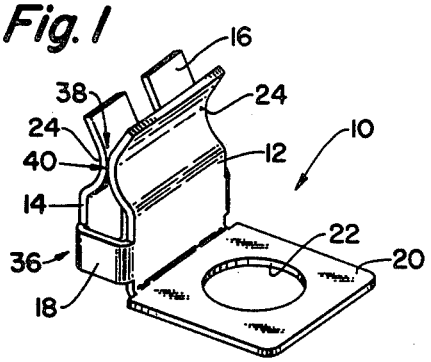
FIG. 1 is a perspective view of an electrical connector made in accordance with the present invention.
Figure 2:
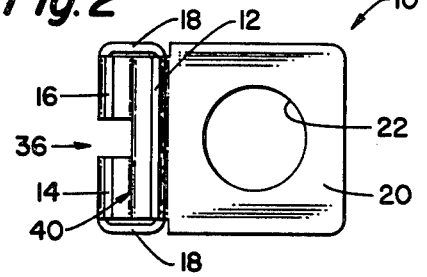
FIG. 2 is a plan view of the connector shown in FIG. 1.
Figure 3:
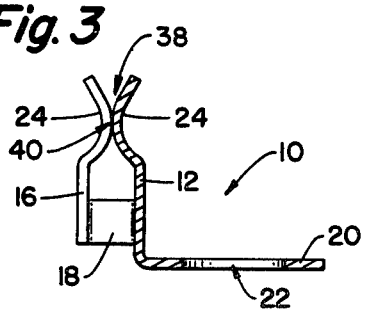
FIG. 3 is a sectional view of the article shown in FIG. 1.

With reference in FIGS. 1, 2 and 3 showing the first embodiment of the present invention, the connector 10 includes a base member 20 and a blade receiving portion 36. The base member includes an aperture 22 which is adapted to receive a threaded fastener. The blade receiving portion 36 includes a first leg 12 with arms 18 connecting second leg 14 and third leg 16 to the first leg 12. In this embodiment all three legs 12, 14 and 16 are resilient and are equipped with concavo-convex portions 24 which are adapted to contact a blade connector. The concavo-convex portions 24 of the legs 12, 14 and 16 produce two significant features. The first feature is the formation of contact surfaces 40. The second significant feature is the formation of a blade receiving opening 38 which as shown in FIGS. 1 and 3 is adapted to facilitate the insertion of a blade connector.

Particular attention is directed to the structural arrangement of the resilient connecting arms 18. It should be noted that the arms 18 are located at the base of legs 14 and 16. The arms 18 are substantially perpendicular to the legs 12 and legs 14 and 16, and therefore act both as a connector and a stiffener for the legs 14 and 16 relative to the leg 12. The location of the connecting arms 18 is away from the free ends of the legs 12, 14 and 16. The result is an increased range of flexibility at the blade receiving opening 38 allowing for easy insertion of a blade connector. It is also significant that the legs 14 and 16 are biased toward the leg 12. This together with the flexibility discussed above provides the connector with a wiping feature which tends to automatically clean a blade connector when the blade is inserted and removed.

It should be noted that the location of the concavo-convex portions 24 near the free ends of the legs 12, 14 and 16 create a flaired opening 38 which further facilitates insertion of a blade connector.

Figure 4:
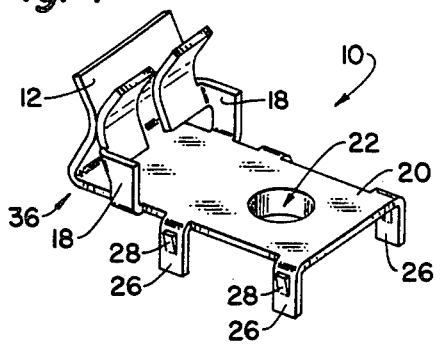
FIG. 4 is a perspective view of a second embodiment of the present invention.

FIG. 4 shows a second embodiment of the invention similar to that shown in FIGS. 1, 2 and 3. In FIG. 4 the connector has a first leg 12. The connecting arms 18 extend upwardly from a portion of said base near the first leg 12. The connector 10 further includes retaining tabs 26 which depend from the planar base member 20. The retaining tabs 26 further include resilient fingers 28 which are adapted to engage a supporting member. The base member 20 has an aperture 22 which includes an extruded collar. The collar is adapted to receive and engage a threaded fastener.

Figure 5:
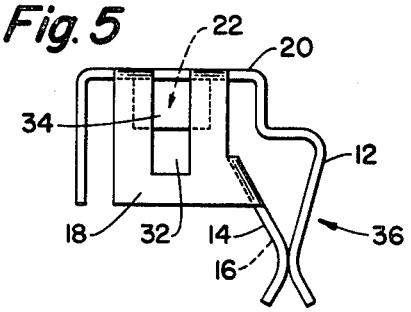
FIG. 5 is a side elevational view of a third embodiment of the present invention.

FIG. 5 is another embodiment of the present invention. In this the third embodiment, a first leg 12 extends from a planar base member 20. Second and third legs 14 and 16 extend from and are connected to opposite sides of the base member 20 by resilient connecting arms 18. In this embodiment the arms 18 include slots 32 which enable them to engage a supporting member. The base member 20 includes an extruded collar 34 around the aperture 22. In the embodiment shown in FIG. 5 the blade receiving portion 36 is directed in substantially the same direction as the collar 34. This is in contrast to FIG. 4 wherein the blade receiving portion 36 and the collar are directed in substantially opposite directions.

It should be noted that the strap-like arms 18 shown in FIGS. 1 through 5 are substantially perpendicular to the legs which they support. This is significant because the strength of the material is maximized in this way for gripping a blade connector.

Figure 6:
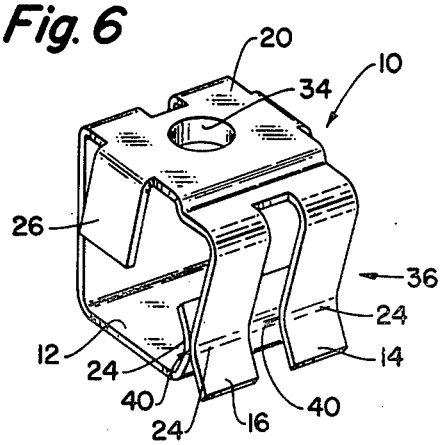
FIG. 6 is a perspective view of a fourth embodiment of the present invention.

FIG. 6 shows a fourth embodiment of the present invention. In this embodiment, a first leg 12 has a C-shape. The C-shaped leg 12 is bent from one side of the planar base member 20. Second and third resilient legs 14 and 16 extend from an opposite side of the planar base member 20. Retaining tabs 26 depend from other edges of the planar base member 20. In this embodiment the legs 12, 14 and 16 include concavo-convex portions near their free ends, to facilitate insertion of a blade connector and to provide contact surfaces 40.

Figure 7:
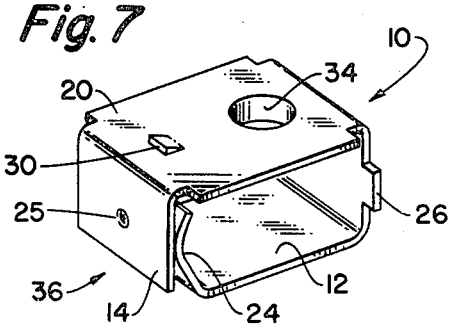
FIG. 7 is a perspective view of a fifth embodiment of the present invention.

FIG. 7 shows a fifth embodiment of the present invention. In this embodiment a first leg 12 extends from one side of a planar base member 20. A second 14 extends from an opposite side of planar base 20. The first leg 21 is C-shaped and includes retaining tabs 26. The embodiment shown in FIG. 7 includes retaining finger 30 which together with retaining tabs 26 are adapted to hold the connector in a supporting member. The second leg 14 includes a concavo-convex portion 24. The concavo-convex portions 24 and dimple 25 provide blade gripping and contacting means.

The embodiments shown in FIG. 6 and 7 include the blade cleaning feature as discussed above. In these embodiments, however, the entire connector 10 acts as a spring to grip a blade connector inserted in the blade receiving portion 36. As a blade is inserted and removed from the conductor, the concavo-convex portions 24 and 25 wipe the blade clean.

In the above described embodiments it should also be noted that the axially extended collar 34 increases the engagement of a fastener.

While for purposes of illustration the embodiment of the present invention have been shown as metal stampings, it should be understood that the present invention contemplates alternative methods of manufacture. It is also contemplated that certain structural modifications may be made without departing from the spirit and scope of the appended claims.

I claim:

1. An electrical connector formed from one piece of sheet metal comprising a planar base and a blade receiving portion generally perpendicular thereto, said base having an aperture through which a fastener can extend in order to hold an electrical terminal in clamped relation to said base, said blade receiving portion including a plurality of resilient legs for contacting and gripping a blade connector, a first leg of said plurality having a C-shape with a fixed end integrally connected to one edge of said base, a second leg integrally connected to an opposite edge of said base, and a free end of said first leg adjacent to a free end of said second leg of said plurality, the free ends of said first and second legs being directed in generally opposite directions, at least one of said plurality of legs having a concavo-convex portion near the free end thereof to provide contact surfaces for and to facilitate insertion of said blade connector.

2. The connector of claim 1 further comprising resilient retaining spring fingers depending from said base for attaching said connector to a supporting member.

3. The connector of claim 1 wherein the base includes a collar extruded therefrom to form means for retaining a threaded fastener.

4. The connector of claim 3 wherein said collar is tapped.

5. An electrical terminal block connector formed from a single piece of sheet metal comprising an apertured base and a blade receiing portion generally perpendicular thereto, said base having an aperture through which a fastener can extend in order to hold an electrical terminal in clamped relation to said base, said blade receiving portion including at least two resilient legs each having a free end, two of said ends pointing in generally opposite directions, said legs being integral extensions of generally opposite edges of said apertured base, said connector including means for snappingly retaining said connector into a supporting member.

6. An electrical connector according to claim 5 wherein said means includes at least one resilient finger struck from said base whereby said connector may be inserted into said member in a direction generally parallel to said base.

7. An electrical connector according to claim 5 wherein said means includes at least one resilient finger depending generally perpendicularly from said base whereby said connector may be inserted into said member in a direction generally perpendicular to said base.

8. An electrical terminal block connector formed from a single piece of sheet metal comprising an apertured base and a blade receiving portion generally perpendicular thereto, said base having an aperture surrounded by an extruded collar integrally formed with said base and adapted to engage a threaded fastener, said blade receiving portion including a pair of resilient legs each having a free end, each of said free ends being integral extensions of generally opposite edges of said apertured base, said base having at least one resilient finger depending therefrom whereby said connector may be snappingly retained by a supporting member.

* * * * *